United States Patent [19]

Pollet

[11] 4,182,282

[45] Jan. 8, 1980

[54] MUSHROOM VALVE HOUSING WITH FLUID COOLANT CIRCULATION FOR INTERNAL COMBUSTION ENGINES

[75] Inventor: Jean-Pierre Pollet, Arnouville les Gonesse, France

[73] Assignee: Societe d'Etudes de Machines Thermiques S.E.M.T., Saint-Denis, France

[21] Appl. No.: 907,702

[22] Filed: May 19, 1978

[30] Foreign Application Priority Data

Aug. 5, 1977 [FR] France ..... 77 24240

[51] Int. Cl.[2] ..... F01P 3/14

[52] U.S. Cl. ..... 123/41.76; 123/41.41; 123/41.77; 123/41.85; 123/188 GC; 123/189

[58] Field of Search ..... 123/41.41, 41.77, 41.76, 123/41.31, 41.85, 188 VA, 188 GC, 189

[56] References Cited

U.S. PATENT DOCUMENTS

| | | | |
|---|---|---|---|
| 1,731,222 | 10/1929 | Blair | 123/41.41 |
| 1,893,209 | 1/1933 | Parkhill | 123/189 |
| 3,945,356 | 3/1976 | Kuhn | 123/41.41 |
| 4,000,730 | 1/1977 | Ottl et al. | 123/189 |
| 4,008,695 | 2/1977 | Bouquet | 123/188 GC |
| 4,131,093 | 12/1978 | Mansfield | 123/41.85 |

FOREIGN PATENT DOCUMENTS

| | | | |
|---|---|---|---|
| 114208 | 10/1899 | Fed. Rep. of Germany | 123/41.77 |
| 252882 | 10/1948 | Fed. Rep. of Germany | 123/41.41 |
| 2441689 | 3/1976 | Fed. Rep. of Germany | 123/41.85 |
| 2632411 | 2/1977 | Fed. Rep. of Germany | 123/41.76 |
| 2558775 | 7/1977 | Fed. Rep. of Germany | 123/41.77 |
| 668962 | 3/1952 | United Kingdom | 123/41.76 |

*Primary Examiner*—Charles J. Myhre
*Assistant Examiner*—Jeffrey L. Yates
*Attorney, Agent, or Firm*—Kenyon & Kenyon

[57] ABSTRACT

The invention provides a mushroom valve housing comprising a cage (1) and a guide (2), Cage (1) comprises legs (3, 4, 5, 6) supporting a valve seat (7) containing an annular space (8). Guide (2) has an annular cavity (9) with two sections (**9*a*, 9*b*) communicating with space (8) by passages (11 to 14). One passage (12) among the two passages (11, 12) connected to a same section (9*b*) freely opens into this section whereas the other passage (11) communicates directly with the other section (9*a*), the passages (11, 13) of two diametrically opposite legs (3, 5) communicating with a same section (9*a***).

7 Claims, 4 Drawing Figures

MUSHROOM VALVE HOUSING WITH FLUID COOLANT CIRCULATION FOR INTERNAL COMBUSTION ENGINES

The present invention relates essentially to a mushroom valve housing with fluid coolant circulation for internal combustion engines.

There are already known mushroom valve housings with fluid coolant circulation for internal combustion engines, which comprise a cage with at least two pairs of legs or webs supporting at their end an annular valve seat containing an annular space for the fluid coolant, and a valve guide incorporating an annular cavity for the fluid coolant separated by a longitudinal partition into at least two sections, namely a fluid-coolant intake section and a fluid-coolant return section. A fluid coolant passage leading to the said annular cavity and the said annular space, respectively, is cut longitudinally in each leg of the said cage. Furthermore, the fluid coolant passages of two successive legs located on one and the same side with respect to the plane of the partition open into the bottom region of one and the same section.

Such a structure of the valve housing, however, results in the fluid coolant from a section of the annular cavity reaching the annular space through two passages cut in two mutually adjacent legs, whereas the fluid coolant leaves the annular space towards the other section of the annular cavity through two passages cut in the remaining two legs, which also are mutually adjacent. As a result, the circulation of the fluid coolant is highly unsatisfactory in the region of the annular space which is comprised between the two fluid coolant inlets into the annular space as well as in the region between the two fluid coolant outlets from the annular space.

Consequently, the valve seat is unequally cooled and in particular insufficiently cooled in the said regions and undergoes unfavourable thermal stresses which may cause its deformation resulting in poor fluid-tightness between the valve and its seat.

The present invention therefore has for its object to obviate the afore-mentioned drawback by providing a solution allowing reliable circulation of the fluid coolant in the annular space of the valve seat to be ensured, so that the latter can be equally sufficiently cooled and may not undergo thermal stresses.

The solution according to the invention consists in a mushroom valve housing with fluid coolant circulation for internal combustion engines, of the type described above, characterized in that one of the said two passages connected to a same section freely opens into that section whereas the other one of the said two passages communicates directly with the other section, and the respective passages of two diametrically opposite legs communicate with one and the same section.

As a result of such a valve housing structure the fluid coolant enters the annular space of the valve seat through two passages located in two diametrically opposite legs and therefore leaves the annular space through the two passages located in the remaining diametrically opposite legs. As a result, fluid coolant circulation in the annular space is altogether satisfactory, for the fluid coolant can flow unhampered towards an outlet passage for the fluid from the annular space. Indeed, considering an inlet passage in one of the legs to the annular space, the two adjacent passages provided in the two legs adjacent to that leg constitute outlet passages for the fluid coolant. The fluid coolant therefore flows freely from an inlet passage to an outlet passage, thus ensuring equal and reliable cooling in all the regions of the annular space, so that the valve seat will not become deformed. The fluid-tightness between the valve and its seat will therefore be satisfactory.

Preferably, each said direct communication between a passage leading to a section and the other section comprises a conduit passing through the said longitudinal partition and connected at one end to the said passage whereas its other, open end opens freely into the said other section. Advantageously, the said conduits pass through a single common opening provided in the said longitudinal partition by being for example superposed on one another in the said opening. Furthermore and according to a preferred characterizing feature of the invention, the valve body is composed of two complementary parts with the transverse junction plane therebetween intersecting the said common opening, the said opening being preferably elongated in parallel relationship to the axis of the valve body, thus facilitating the positioning of the said conduits and allowing a proper circulation of the said fluid coolant in the annular space of the valve seat to be obtained.

Other purposes, characterizing features, details and advantages of the present invention will appear more clearly from the following explanatory description with reference to the appended drawings of a presently preferred form of embodiment of a valve housing according to the invention, given solely by way of example.

Figure 1:
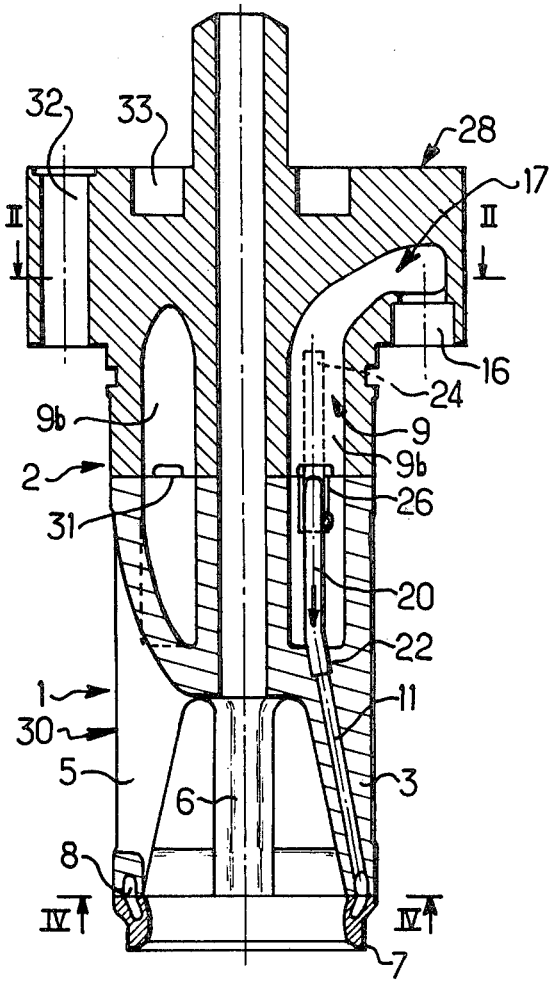
FIG. 1 is a longitudinal sectional view of a valve housing upon I—I of FIG. 2.

Referring to FIG. 1, a mushroom valve housing with fluid coolant circulation for internal combustion engines comprises a valve cage 1 and a valve guide 2. In order that the drawing may be better understood, the valve with its stem engaged in the valve housing is not shown.

The valve cage 1 comprises at least two pairs of legs or webs 3, 4, 5, 6 (FIG. 2) supporting at their end an annular valve seat 7 containing an annular space 8 (FIG. 4) for the fluid coolant. The valve guide 2 incorporates an annular cavity 9 for the fluid coolant, separated by a longitudinal partition 10 (FIG. 2) into at least two sections *9a, 9b,* namely a coolant intake section *9a* and a coolant return section *9b.* A longitudinal fluid coolant passage 11, 12, 13, 14 (FIG. 2) is cut in each arm 3, 4, 5, 6, respectively, leading to the annular cavity 9 and the annular space 8, respectively. The fluid coolant passages (11, 12), (13, 14) of two successive legs located on a same side with respect to the plane of the partition 10 (legs 3, 4; 5, 6, respectively) open into the bottom region of each section (section *9b* or *9a,* respectively).

Figure 2:
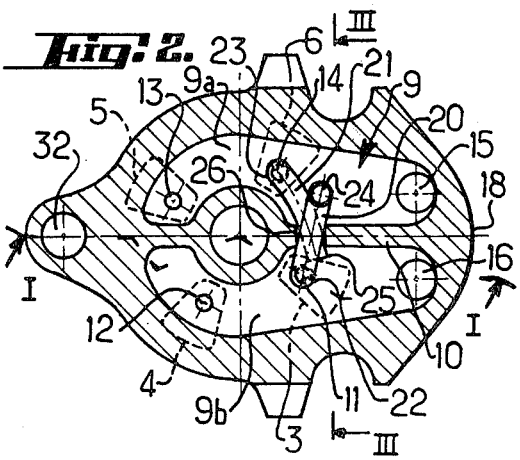
FIG. 2 is a sectional view upon II—II of FIG. 1.

In the example illustrated, the passage 12 among the two fluid coolant passages 11, 12 connected to a same section *9b* freely opens into this section, whereas the other passage 11 of the two fluid coolant passages 11, 12 communicates directly with the other section *9a,* as seen in FIG. 2. Furthermore, the respective fluid coolant passages (11, 13; 12, 14) of two diametrically opposite legs (3, 5; 4, 6) communicate with a same section (*9a; 9b,* respectively).

Advantageously, the valve housing is of the type for overhead valves, whose fluid coolant inlet and outlet, 15 and 16 respectively, open into the upper region 17 of the annular cavity 9 and are located on either side, respectively, of the partition 10 towards a same end 18 thereof (FIG. 2). Also, the passage 12 among the two fluid-coolant passages 11, 12 connected to a same section 9*b* and which opens freely into the section 9*b* is the remotest from the fluid coolant inlet 15 and outlet 16.

Preferably, each direct connection of a coolant fluid passage (11, 14), leading to a section (9*b*, 9*a*, respectively), with the other section (9*a*, 9*b*, respectively) comprises a conduit (20, 21, respectively) passing through the longitudinal partition 10 and connected at one end (22, 23, respectively) to the cooling fluid passage (11, 14, respectively) whereas the other, open end (24, 25, respectively) opens freely into the other section (9*a*, 9*b*, respectively) (FIG. 2).

Advantageously, the free end 24 of the fluid coolant conduit 20 opening into the fluid coolant intake section 9*a* is preferably closer to the upper inlet 15 than to the lower bottom of the section 9*a* and is directed towards the fluid coolant inlet 15 or to the fluid-coolant local intake.

Figure 3:
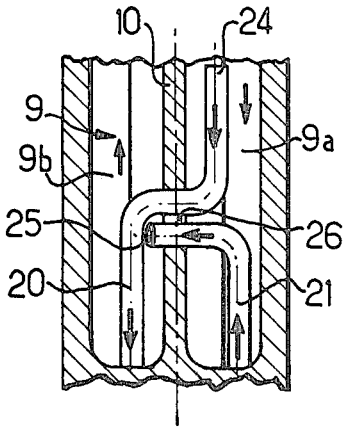
FIG. 3 is a sectional view upon III—III of FIG. 2.

Preferably, the coolant fluid intake conduit 20 is double-elbowed or bent in mutually opposite directions, whereas the fluid coolant return conduit 21 is preferably simply elbowed or bent (FIG. 3).

According to a preferred characterizing feature, the fluid coolant conduits 20, 21 pass through a single common opening 26 provided in the longitudinal partition 10, by being for example superposed on one another as seen in FIGS. 2 and 3.

The valve housing is preferably constituted by two complementary parts 28, 30 with a transverse jointing plane 31 intersecting the common opening 26 for the conduits 20, 21. The opening 26 is preferably elongated in parallel relationship to the axis of the valve housing, thus facilitating the positioning of the conduits 20, 21 in the valve housing.

The valve housing also comprises suitable means such as 32, 33 for fastening the same in the engine cylinder head.

Figure 4:
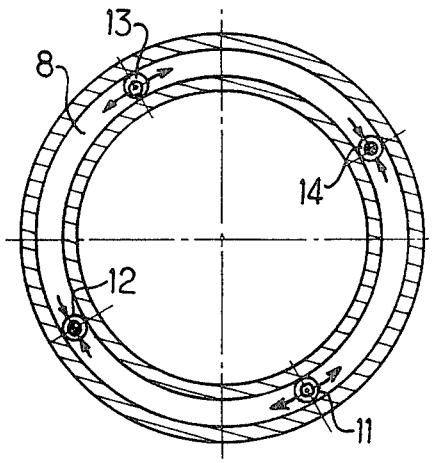
FIG. 4 is a sectional view upon IV—IV of FIG. 1.

The cooling of the valve guide 2 and particularly of the valve seat 7 takes place as described in the following with reference to FIGS. 2 and 4.

The fluid coolant flows through the inlet 15 into section 9*a* of the annular cavity 9 of the valve guide 2. The fluid coolant is under sufficient pressure for it to enter both the passage 13 and the conduit 20 connected to the passage 11 and to reach the annular space 8 of the valve seat 7 through the diametrically opposite legs 3, 5, from which it freely flows in the direction of the arrows of FIG. 4 into the passages 12, 14 of the diametrically opposite legs 4, 6 serving as outlets for the fluid coolant from the annular space 8 of the valve seat 7. The fluid coolant returns from the annular space 8 of the valve seat 7 through the passage 12 and the passage 14 associated with the conduit 21 into the section 9*b* of the cavity 9 of the valve guide 2, and finally leaves the valve housing through the fluid coolant outlet 16.

As appears from the foregoing, the fluid coolant circulates freely and in the same manner, in all the regions located between a fluid coolant inlet passage and outlet passage, in the annular space 8 of the valve seat 7. Consequently, a cooling is obtained that is uniform, i.e. equally distributed in the annular space 8 of the valve seat 7, thus preventing local thermal stresses capable of deforming the valve seat, resulting in poor fluid-tightness between the valve and the seat.

Of course the invention is by no means limited to the form of embodiment described and illustrated which has been given by way of example only. In particular, it comprises all means constituting technical equivalents to the means described as well as their combinations, should the latter be carried out according to its gist and within the scope of the following claims.

What is claimed is:

1. A mushroom valve housing with fluid coolant circulation for internal combustion engines, comprising a cage and at least two pairs of legs or webs supporting at their end an annular valve seat containing an annular space for the said fluid coolant, and a valve guide incorporating an annular cavity for the said fluid coolant, separated by a longitudinal partition into at least two sections, namely a fluid coolant intake section and a fluid coolant return section, a fluid coolant passage leading to the said annular cavity and to the said annular space, respectively, being cut longitudinally in each of the said legs, the fluid coolant passages of two successive legs located on one and the same side with respect to the said partition opening into the bottom region of a same section, wherein one of the said two fluid coolant passages connected to a same section opens freely into that section whereas the other of the said two fluid coolant passages communicates directly with the other section, and the respective fluid coolant passages of two diametrically opposite legs communicate with a same section.

2. The valve housing of claim 1 for an overhead type valve whose fluid coolant inlet and outlet open into the lower region of the said annular cavity and are located on either side, respectively, of the said partition towards a same transverse end thereof, wherein the said one of the two fluid coolant passages connected to a same section which freely opens into that section is the passage that is remotest from the said fluid coolant inlet and outlet.

3. The valve housing of claim 1, wherein each said direct communication between said fluid coolant passage leading to a section and said other section comprises a fluid coolant conduit passing through the said longitudinal partition and connected at one end to the said fluid coolant passage whereas its other, open end opens freely into the said other section.

4. The valve housing of claim 3, wherein the free end of the said fluid coolant conduit opening into the fluid coolant intake section is preferably closer to the upper inlet than to the lower bottom of that section and is directed towards the said inlet.

5. The valve housing of claim 3, wherein the said fluid coolant intake conduit is doubly elbowed or bent in two mutually opposite directions, whereas the fluid coolant return conduit is preferably simply elbowed or bent.

6. The valve housing of claim 3, wherein the said fluid coolant conduits pass through a single common opening provided in the said longitudinal partition, being for example superposed on one another in the said opening.

7. The valve housing of claim 6, wherein it is constituted by two complementary parts with a transverse junction plane intersecting said common opening, with said opening being preferably elongated in parallel relationship to the axis of the valve housing.

* * * * *